United States Patent [19]

Goulter

[11] Patent Number: 4,475,727

[45] Date of Patent: Oct. 9, 1984

[54] WORKBENCH WITH MULTIPLE-CLAMPING ARRANGEMENT

[76] Inventor: Victor H. Goulter, 485 Molimo Dr., San Francisco, Calif. 94127

[21] Appl. No.: 478,061

[22] Filed: Mar. 23, 1983

[51] Int. Cl.[3] ..... B25B 1/10

[52] U.S. Cl. ..... 269/88; 269/154; 269/155; 269/204; 269/295

[58] Field of Search ..... 269/204, 88, 154, 155, 269/900, 295; 144/286 R, 286 A, 285

[56] References Cited

U.S. PATENT DOCUMENTS

| | | | |
|---|---|---|---|
| 1,574,528 | 2/1926 | Youngman et al. | 144/286 R |
| 1,954,708 | 4/1934 | Mass | 269/900 |
| 4,096,777 | 6/1978 | Adams | 269/295 |
| 4,252,304 | 2/1981 | Pettican | 269/154 |
| 4,330,113 | 5/1982 | Ferdinand et al. | 269/88 |
| 4,415,149 | 11/1983 | Rees | 269/88 |

FOREIGN PATENT DOCUMENTS

| | | | |
|---|---|---|---|
| 852379 | 8/1952 | Fed. Rep. of Germany | 144/286 |

*Primary Examiner*—Robert C. Watson

*Attorney, Agent, or Firm*—David Pressman

[57] ABSTRACT

A packagable workbench comprises work surfaces (1) and (1*a*) separated by slot (2). A sliding member (22) can be moved lengthwise and locked or unlocked on the work surface (1*a*) to form a positional stop opposite a pivotable force-applying tool (52). Said sliding member (22) also has exchangable fittings for tightly securing and clamping workpieces when force is applied by the force tool (52). The work surface is supported by legs (3) to which fixtures (7) can be attached for supporting a tool deck (8) and bi-sliding drawers (18) for tools and one end of stay rods (10). The legs (3) also provide vertical posts for mounting adjustable sawhorse supports (64) and plank (61). Further the work surface (1) supports a screw press (68) by tension rods (76) attached thereto for pressure applications in combination or separate. The work surface (1) also provides a fixed stop (19) removably attached to work surface (1) for along-the-bench clamping of workpieces by pressure applied from the force tool (52) when pivoted. The work surface (1) further supports a pivoted drawer (11) for accessories and the other end of the stay rods (10) for rigidity. The workbench can be dismantled and packaged into a compact kit for shipping and storage.

1 Claim, 27 Drawing Figures

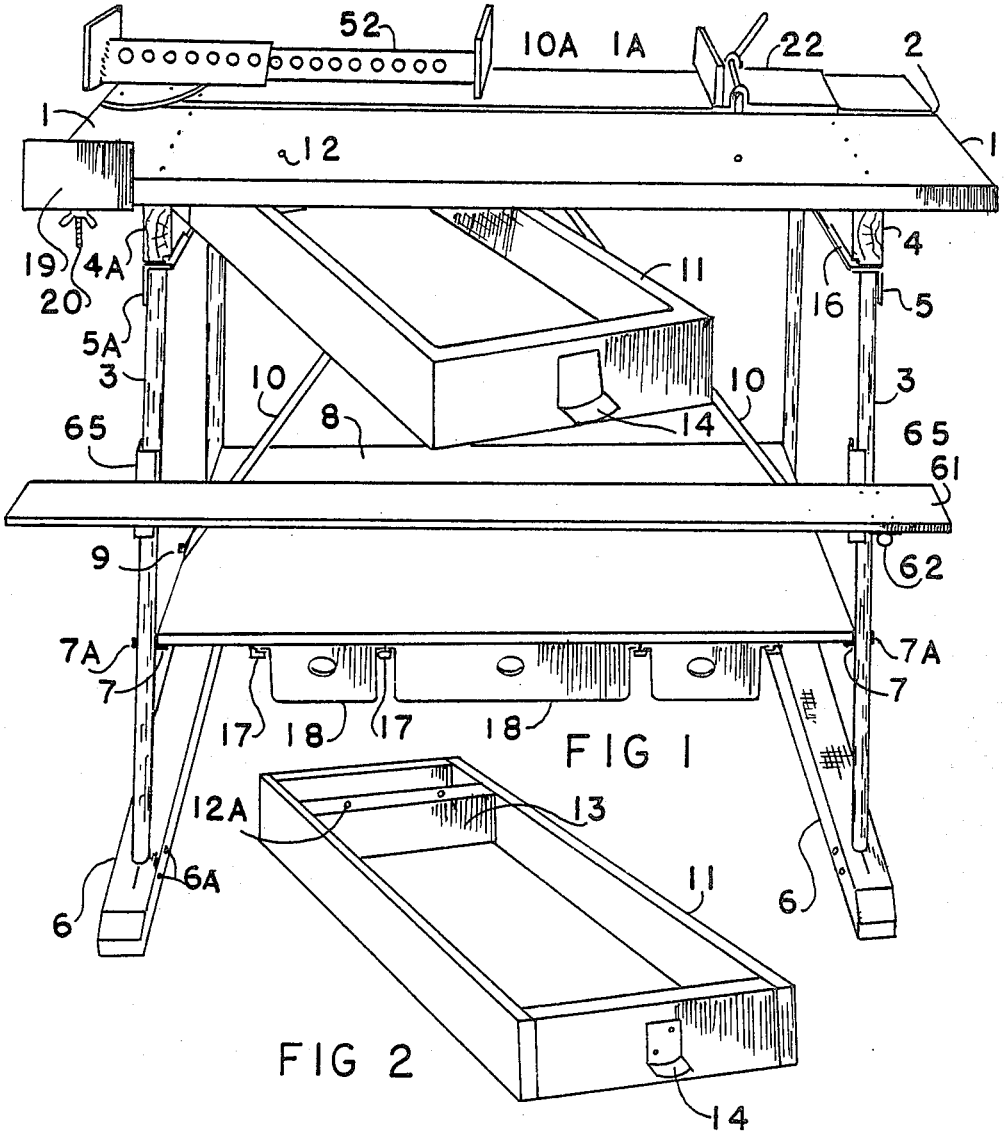
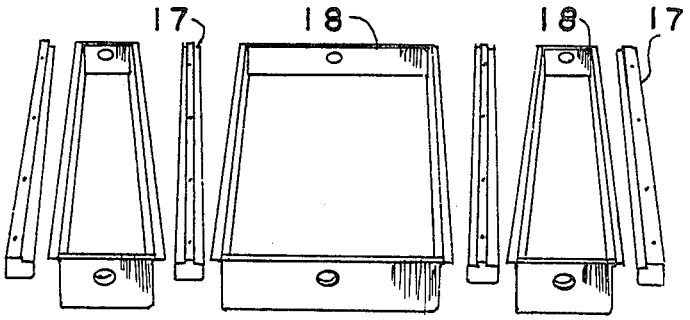
FIG 3

WORKBENCH WITH MULTIPLE-CLAMPING ARRANGEMENT

BACKGROUND

1. Field of Invention

This invention relates to a packagable multi-use workbench and attachments for using same, especially in conjunction with a force tool for clamping and positioning workpieces.

2. Prior Art

In prior-art workholders, the clamping range (thickness of material which can be held) is very limited. Attempts have been made to increase this range, but these have resulted in lack of rigidity. Furthermore, prior-art systems were extremely slow in operation, particularly where screw-thread force means were used, and clamps or bolt-on stops were employed.

Some systems used pegs in holes as stops, but these quickly became damaged and worn or were unsuitable for holding workpieces of a variety of shapes. Some clamped the workpieces too far from the side of the bench, causing backache and fatigue, particularly with retired people, and some benches would not stay in place, but shifted in use. Some were not rigid enough to permit hammering or chiseling to be done. In others the clamping face was narrow and hard, resulting in damage to the workpiece, particularly when the face material itself became damaged.

No provision was made to hold the workpieces in a variety of positions so that the user could select the best position. Most prior-art systems provided little or no place to rest a large tool for periods when it was not in use, as a result of which it was left on top of the bench, where it was subject to falls and resulting damage.

Most workbenches provided no sawhorse. One that did was so slow and awkward to adjust and was so high that only a very tall person was comfortable using it.

In general workbenches have not changed since the seventeenth century.

OBJECTS

Accordingly, several objects of the present invention are to provide means for quick securing, clamping, holding and positioning workpieces of a great variety of sizes, shapes, and lengths in the most suitable position for comfortable working thereon. Another object is to provide a workbench which is stable enough to withstand hammering and other heavy usage. Further objects are to provide a workbench which is heavy enough to remain in place under normal work, yet light enough to be moved around or loaded by one adult person; to provide a sawhorse that can be easily and quickly adjusted in height to suit tall or short users; and to provide a sawhorse in which the angle of tilt can be adjusted. Additional objects are to provide a bench with easily-accessible drawers for accessories and tools as well as sufficient space and a safe place for larger tools. Still further objects are to provide a workbench that can be dismantled and reassembled into a compact package for shipping, moving, storing, or transporting. Further objects and advantages of my invention will become apparent from a consideration of the drawings and ensuing description thereof.

DRAWINGS

Sheet No. 1

FIG. 1 is a perspective front view of the workbench of the invention.

FIG. 2 is a perspective view of a swivelled drawer used with said bench.

FIG. 3 is a perspective expanded view of tool drawers and tool drawer runners used with said bench.

Sheet No. 2

Figure 4:
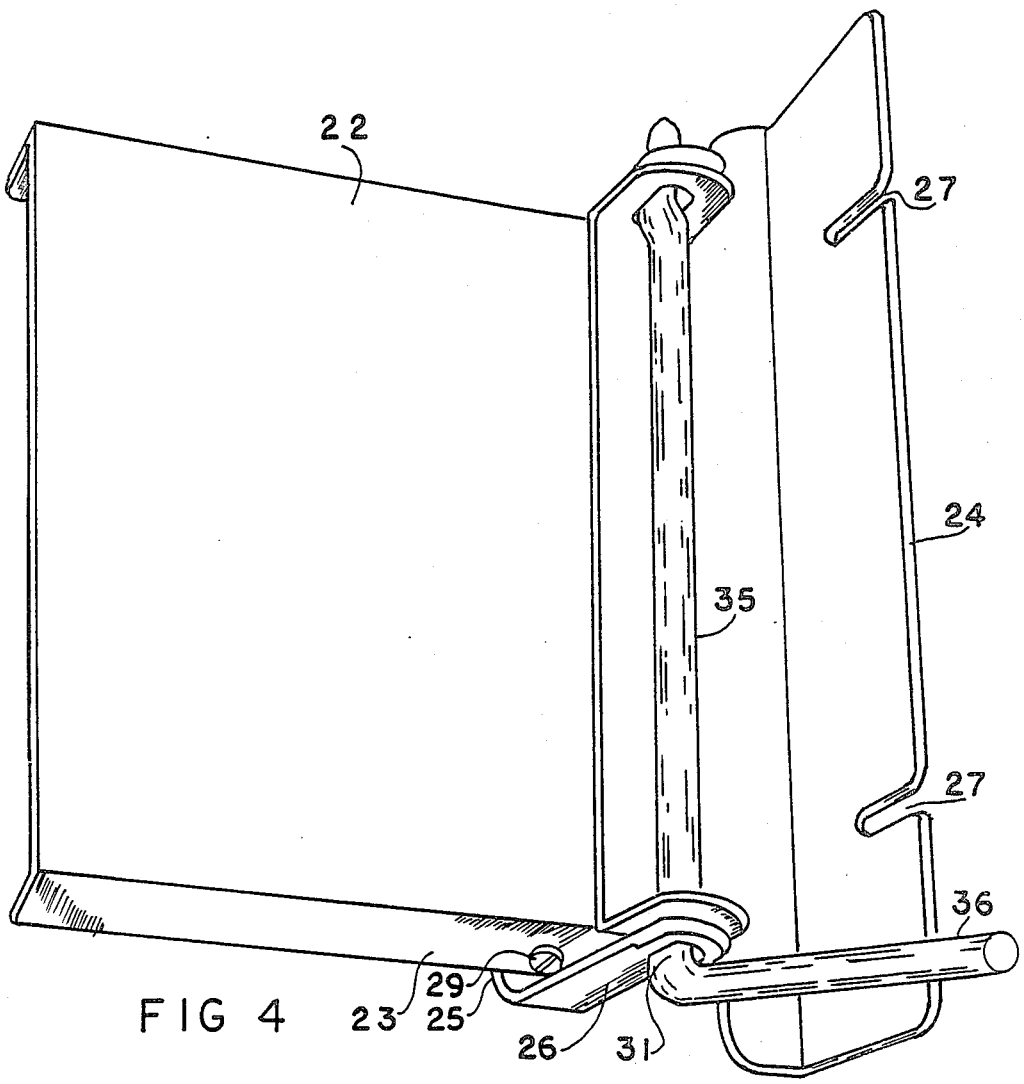

FIG. 4 is a perspective view of a sliding lockstop member used with said bench.

Figure 5:
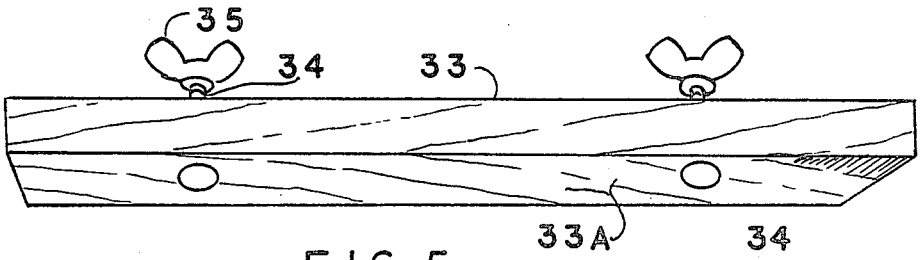

FIG. 5 is a perspective view of a sliding lockstop member wooden faceplate used with said bench.

Sheet No. 3

Figure 6:
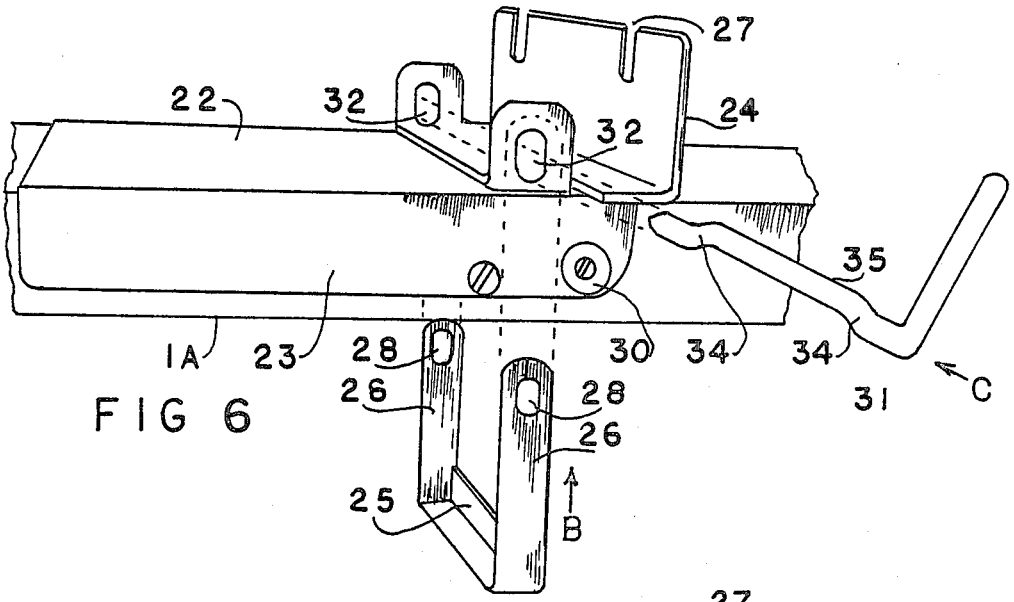

FIG. 6 is an exploded perspective view of the entire lockstop.

Figure 7:
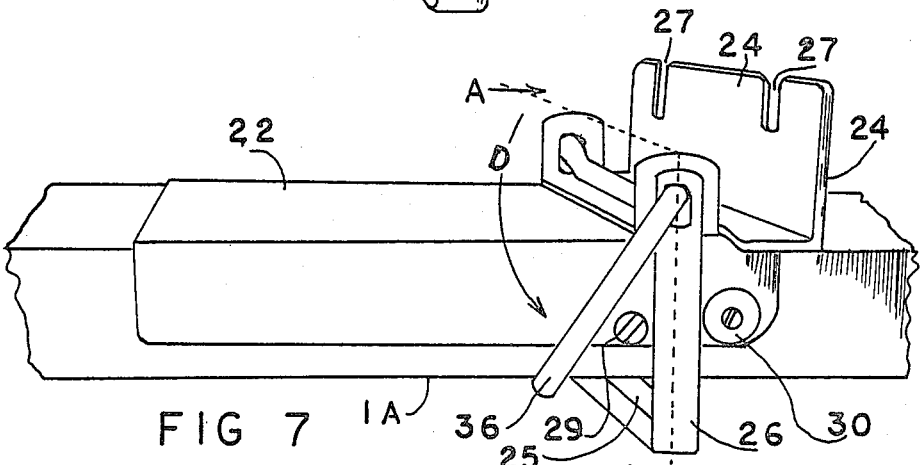

FIG. 7 is a perspective view of the sliding lockstop member attached to part of the workbench.

Figure 8:
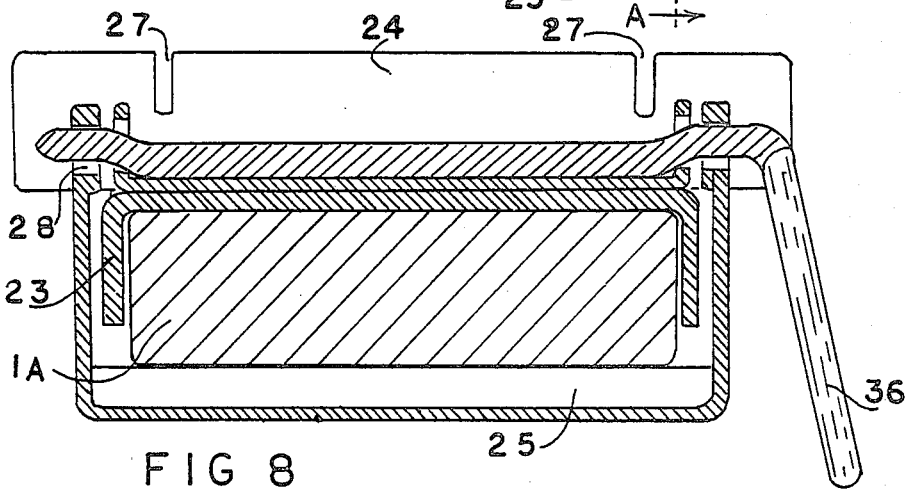

FIG. 8 is a cross-section view taken along the lines A—A of FIG. 7.

Sheet No. 4

Figure 9:
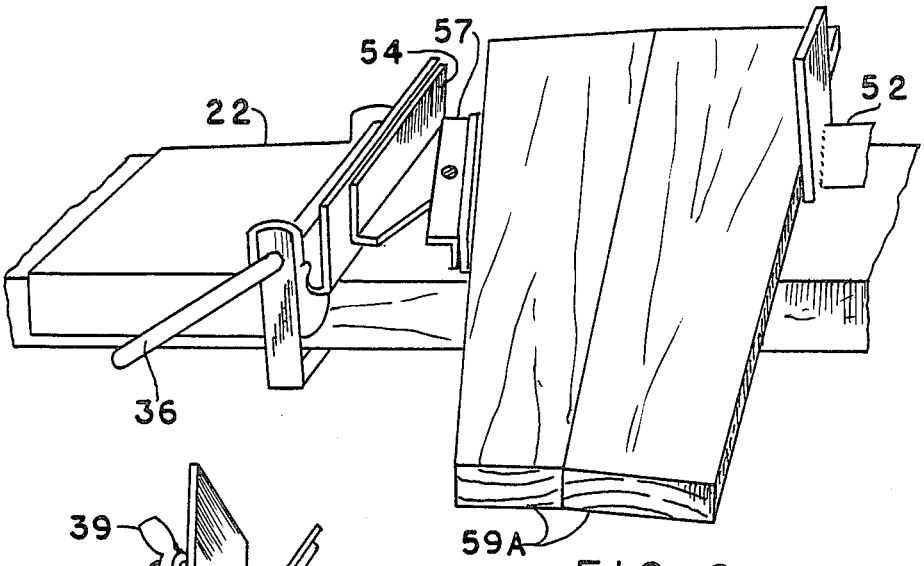

FIG. 9 is a perspective view of a sliding lockstop fitted with a pivoted jaw accessory holding a tapered workpiece.

Figure 10:
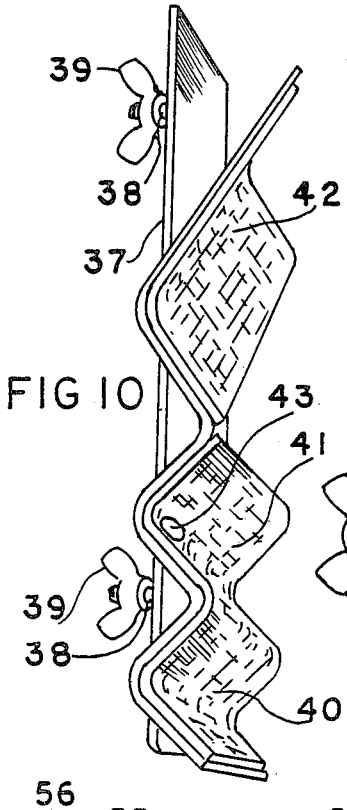

FIG. 10 is a perspective view of a sliding lockstop accessory having vertical and inclined workpiece holding grooves.

Figure 11:
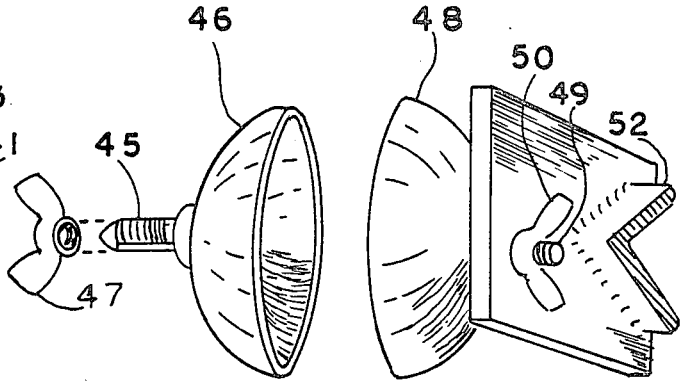

FIG. 11 is a perspective view of a cupped workpiece holding attachment.

Figure 12:
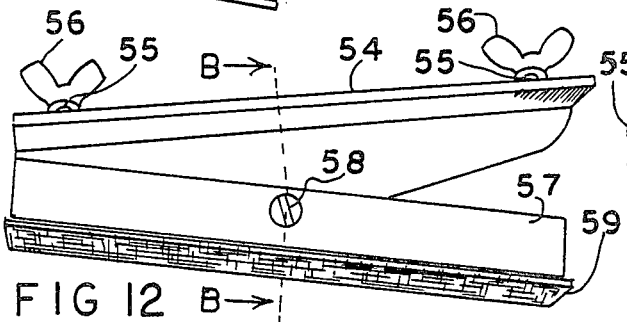

FIG. 12 is a perspective view of a pivoted jaw accessory for the sliding lockstop of FIG. 9.

Figure 13:
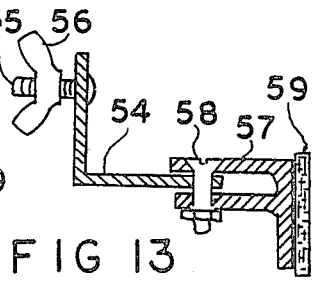

FIG. 13 is a cross section taken along the lines B—B of FIG. 12.

Sheet No. 5

Figure 14:
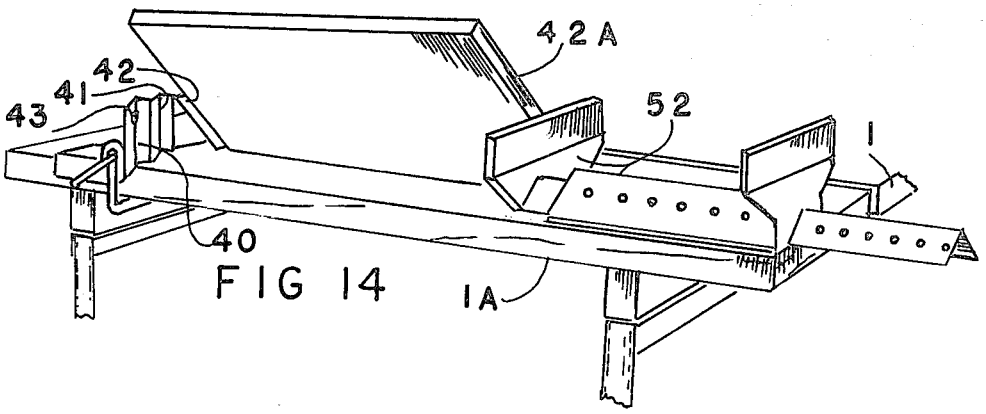

FIG. 14 is a perspective view of the lockstop accessory of FIG. 10 clamping a workpiece at an angle.

Figure 15:
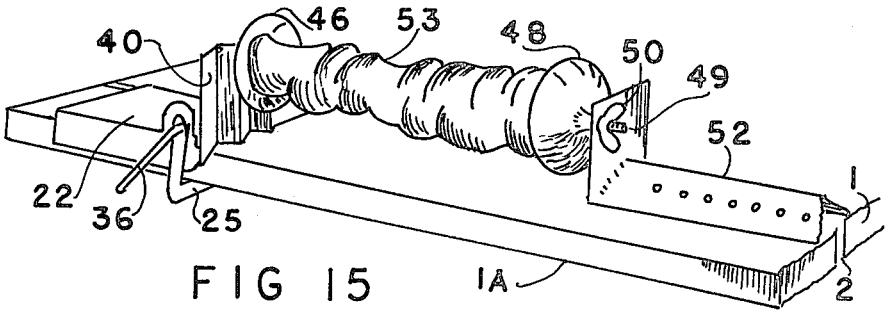

FIG. 15 is a perspective view of the sliding lockstop clamping a workpiece at its ends.

Figure 16:
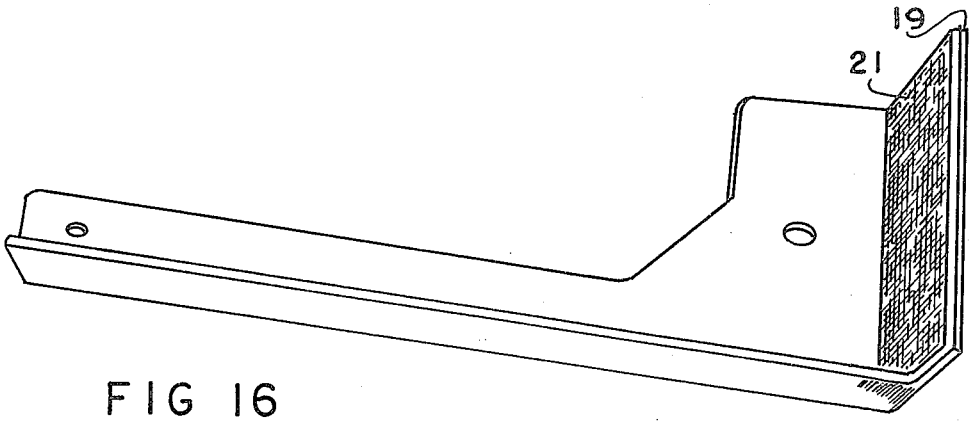
Figure 17:
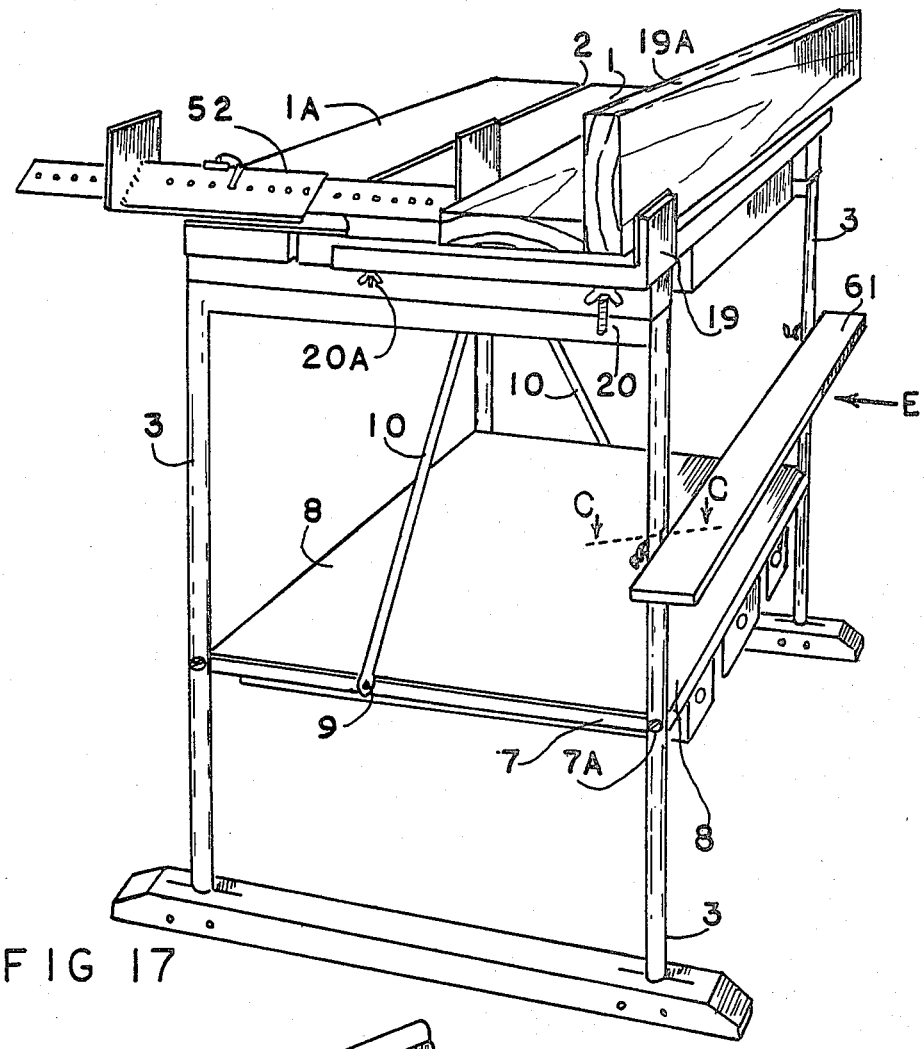

FIG. 16 is a perspective view of the fixed stop of FIGS. 1 and 17.

Sheet No. 6

FIG. 17 is a perspective view of a workpiece clamped lengthwise on the bench against the fixed stop.

Figure 18:
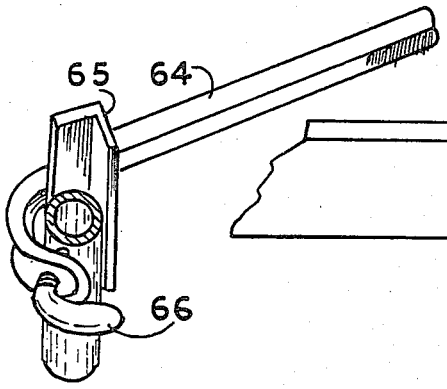

FIG. 18 is a sectional view taken along the lines C—C of FIG. 17 with the sawhorse plank removed.

Figure 19:
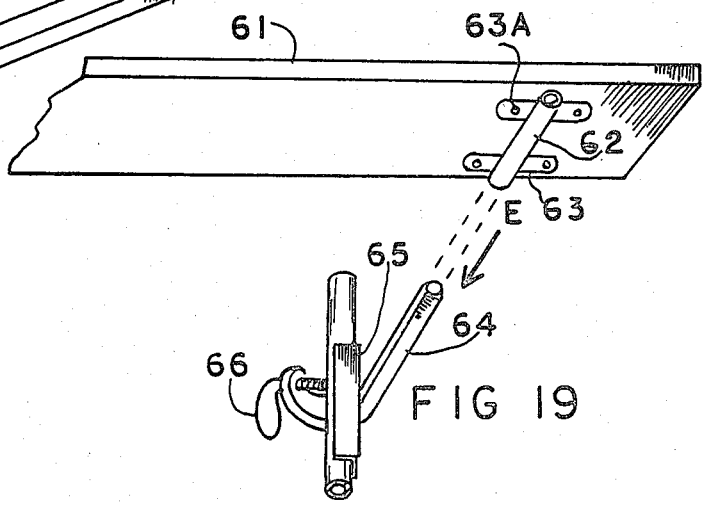

FIG. 19 is an exploded view of the sawhorse plank and sawhorse support attached to a section of the workbench leg.

Sheet No. 7

Figure 20:
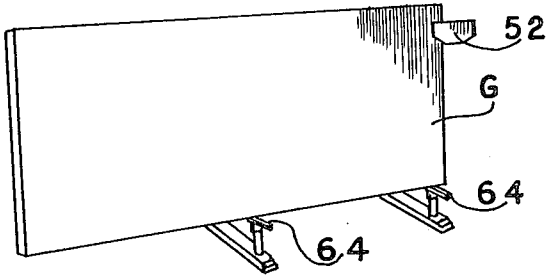

FIG. 20 is a perspective view of the workbench holding a large workpiece in a vertical position.

Figure 21:
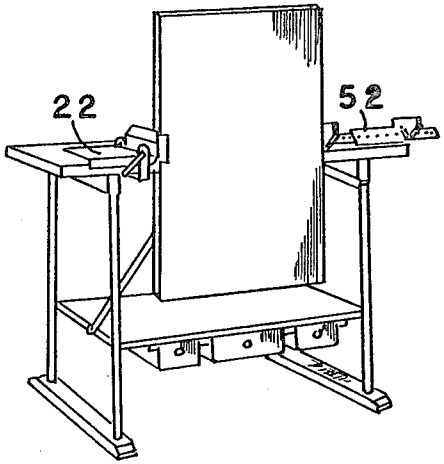

FIG. 21 is a perspective view of a large workpiece clamped between the lockstop and the force tool, vertically on the side of the workbench.

Figure 22:
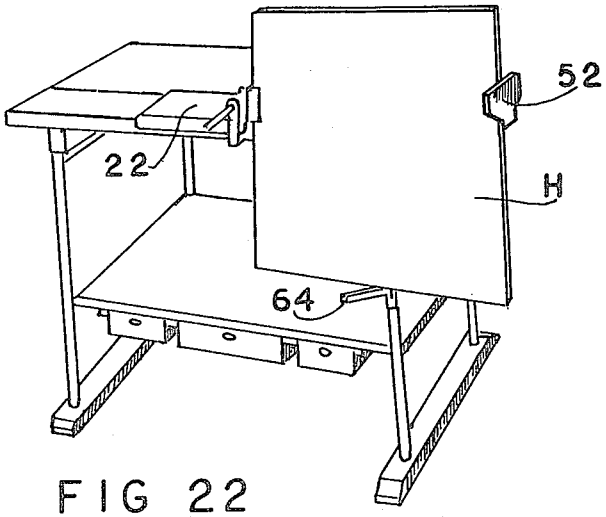

FIG. 22 is a perspective view of a workpiece clamped by the lockstop and force tool in a vertical position and further supported by a sawhorse support.

Figure 23:
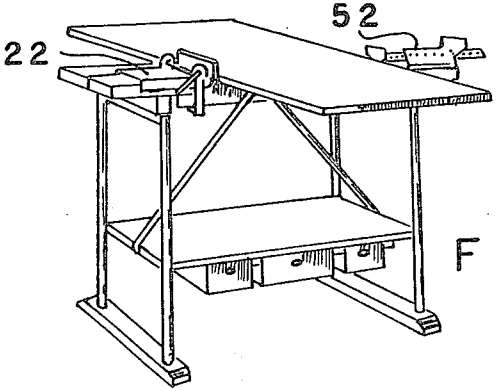

FIG. 23 is a perspective view of a workpiece clamped across the top of the workbench in a horizontal position.

Sheet No. 8

Figure 24:
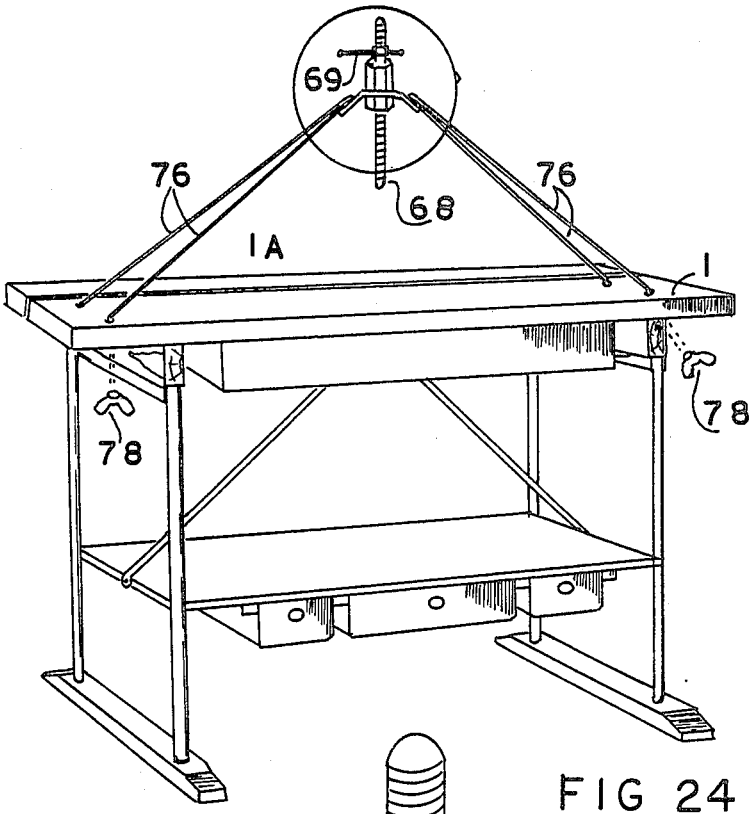

FIG. 24 is a perspective view of the workbench with the vertical screw-type press attached.

Figure 25:
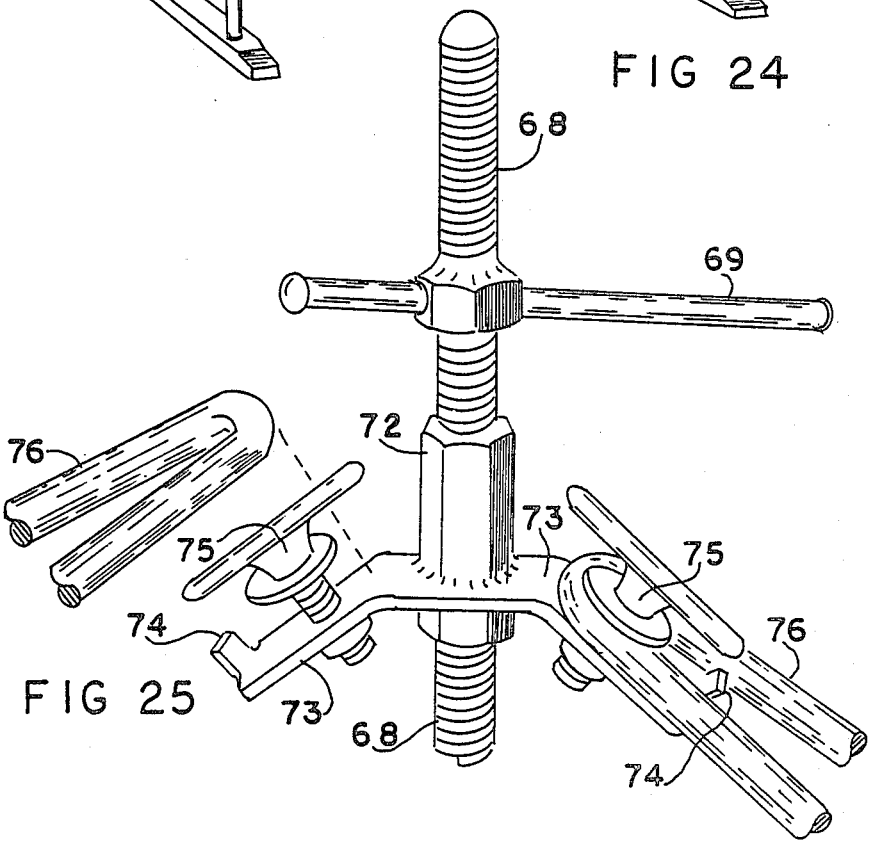

FIG. 25 is a partly exploded view of the encircled portion of FIG. 24.

Sheet No. 9

Figure 26:
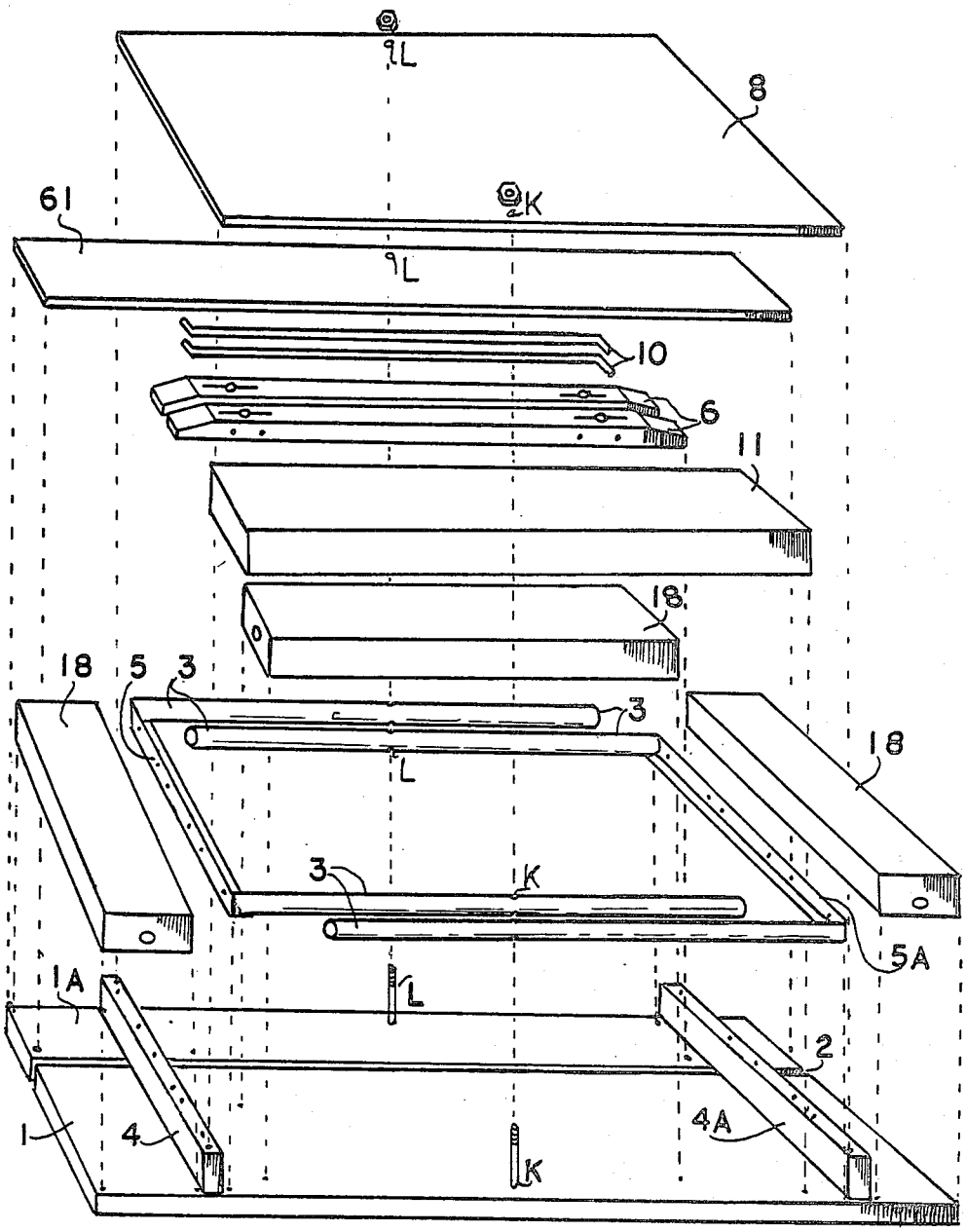
Figure 27:
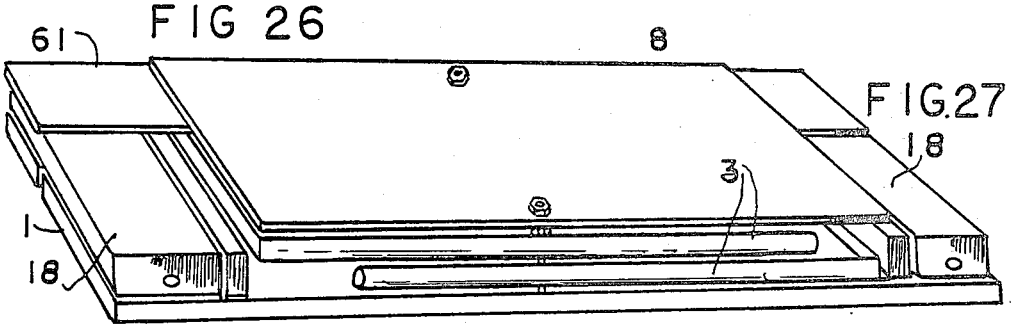

FIG. 26 is an exploded view of the workbench kit package of of FIG. 27

FIG. 27 is a perspective view of the workbench assembled into a kit.

FIGS. 1–3

Bench And Its Drawers

FIG. 1 shows a workbench having a robust bench top 1 in which a slot 2 is formed either by mounting a wooden plank 1*a* horizontally spaced from the edge of top 1, or by cutting a slot at least most of the length of the bench, sufficient to form a slot about 1.25 cm (0.5 in) wide.

A fixed stop 19 is attached to top 1 by bolts and wingnuts 20 and 20*a* for easy removal or lowering when not in use. It is preferably made of metal and the protruding face lined with rubber or rubber/canvas or like material 21, as shown in FIG. 16. The fixed stop is mounted on the corner of bench top 1 so that when a force tool 52 is swivelled to face it, long workpieces can be clamped lengthwise on the bench and can protrude over the ends of the bench. Also, as these workpieces are supported by the bench top, close to its edge, it is possible for the user to work without leaning over the bench to reach the workpiece.

Bench top 1 and plank 1*a* preferably are made of wood, e.g., beech or maple, and are glued and bolted to two cross members 4 and 4*a*, also preferably made of wood. These may be set back from the bench ends so that the bench ends protrude about 14 cm (5.5 in) beyond the cross members. The bolt holes in the bench top and the cross members should be countersunk to allow the bolt heads and the nuts to be positioned at or below surface level. The threaded sections of the bolts extend far enough to pass through a pair of metal cross beams 5 and 5*a*, where a second nut is threaded onto each to secure the cross beams to the cross members.

Metal legs 3 are welded or otherwise attached to cross beams 5 and 5*a* and extended downwards and partly penetrate a respective pair of bored and slotted skids 6 and are clamped thereto by bolts 6*a*. About 33 cm (13 in) from the floor, metal brackets 7 are attached by bolts 7*a*, to support a tool deck 8, preferably but not necessarily of wood, which in turn provides anchor points 9 for two stay rods 10. Rods 10 converge upwards and are attached by a bolt 10*a*, which passes through the bench top near its center. The stay rods thus provide a rigid support for the legs, tool deck, and bench top.

A swivel-mounted drawer 11 is pivoted by a single bolt 12 which passes through bench top 1 and through hole 12*a* in a drawer support beam 13 (FIG. 2). This drawer is in a convenient position such that it can be opened and closed from any position around the workbench. It can be constructed of wood or any suitable material and carries a support bracket 14 which engages a slot 16 cut in cross member 4 when the drawer is closed. This drawer is provided to house the workbench components and accessories in a convenient place and is easily accessable for opening and closing from any position around the workbench.

Drawer runners 17 (FIGS. 1 and 3) are attached to tool deck 8 and support three part metal/part wood drawers 18 for the storage of small tools and other supplies. For convenience, these can be opened from either side of the workbench.

FIGS. 1, 4, 5, 6, 7, and 8

Sliding Lockstop

FIGS. 1, 4, 5, 6, 7, and 8 show a sliding lockstop 22, preferably of metal and comprising an inverted channel having side flanges 23 which form guides, and a raised face 24 having slots 27 to which accessories can be attached. A locking bar 25 passes under plank 1*a* and has upward extending arms 26 with elongated holes in their upper ends. Arrow "B"(FIG. 6) shows the direction in which bar 25 is installed between stop 29 and rubber washer 30 on a sliding lockstop member guide 23 (FIG. 6). Arrow "C" (FIG. 6) shows the direction in which locking pin 31 is installed through holes 28 and 32 to retain locking bar 25 in the unlocked position. Kinks 34 in locking pin 31 forms a cam 35, such that when the pin is turned by its handle 36 in the direction of arrow "D" (FIG. 7), cam 35 raises bar 25, thus causing the bar to contact plank 1*a* and effect a rigid attachment on plank 1*a* and channel 22.

Increased clamping pressure can be applied from force tool 52 described in my copending U.S. application Ser. No. 06/266,500 filed May 22, 1981 now Pat. No. 4,449,704. When used to clamp any workpiece against lockstop face 24, or any accessory attached thereto, this will cause sliding member 22 to move slightly, which in turn will cause upward extending arm 26 to tilt. This forces both lockstop body 22 and locking bar 25 to grip plank 1*a* more firmly, forming a more positive grip.

In order to release the locking bar and the workpiece, handle 36 is raised, thereby raising cam 35 and lowering locking bar 25 out of engagement. Rubber washer 30 will then throw arm 26 back into a vertical position. Alternatively, the workpiece can be released by reversing the clamping force from force 52.

A wooden faceplate 33 (FIG. 5) is fitted with bolts 34 which may be inserted into respective slots 27 and retained there by wingnuts 35. This provides a flat surface against which workpieces can be clamped by force means 52. Wooden faceplate 33 can further be lined with rubber or rubber/canvas and such lining maybe glued to faceplate 33*a* with instant or rapid glue to provide a relatively soft but good grip face for wooden or other workpieces.

FIGS. 10–15

Other Workpiece Holders

A vertical and inclined workpiece holder, shown in FIG. 10, comprises a zig-zag member which can be attached to raised face (FIG. 6) for a vertical position, perpendicular to the workbench; for this the work is placed in vertical grooves 40 or 41 of the zig-zag member. Additionally the work can be mounted at an angle of 45 degrees to the bench top by using grooves 42, as shown in FIG. 14. These grooves can be lined with rubber, as described above.

The vertical and inclined workpiece holder (FIG. 10) comprises a rigid metal bar 37 fitted with bolts 38 and wingnuts 39. Welded or otherwise attached to bar 37 are angle grooves 40, 41, and 42, thereby to form a zig zag member. Groove 41 incorporates an elongated hole 43 through which a threaded stem 45 on a cupped workpiece holder 46 (FIG. 11) is inserted and retained by a wingnut 47. A second cupped workpiece holder 48 is attached and retained, by threaded stem 49 and wingnut 50, to jaw 51 of force-applying tool 52. These two cupped workpiece holders are used for workpieces such as chair legs, lampstandards, and the like, as shown in FIG. 15. The cupped workpiece holders are designed to firmly clamp a workpiece of the type discribed, such that hammering and chiseling and carving can be performed without the workpiece moving out of position, yet the workpiece can be turned as required without releasing the clamping pressure.

An angled bracket (FIGS. 12–13) is fitted with bolts 55 for engaging slots 27 in raised face 24 (FIG. 6) and is retained there by wingnuts 56. Bracket 54 carries a jaw 57, which can rotate about a pivot 58. Rubber or other gripping materials 59, as earlier described, can be glued to the face of jaw 57. This accessory is used for clamping workpieces that do not have parallel sides, as shown in FIG. 9.

FIGS. 17–19

Sawhorse Attachment

A sawhorse plank 61 (FIG. 17) is fitted with a positioning tube 62 and lugs 63 attached by bolts 63*a*. Plank 61 is mounted to sawhorse support 64 (FIGS. 18 and 19) by moving it in the direction of arrow "E" in FIGS. 17 and 19. Support 64 comprises a metal bar to which an angle bracket 65 is welded at 90 degrees. At one end bar 64 is bent, drilled, and threaded, such that when threaded thumb screw 66 is inserted and tightened onto a round object as shown in FIG. 18 or a leg of the bench, the other end of bar 64 will extend out rigidly, horizontally, and at right angles to the round object or bench leg. Thus, sawhorse plank 61 will be firmly supported, yet can be raised and lowered at either or both ends, thereby providing a readily adjustable platform to suit tall or short users. Furthermore, the plank can be easily removed, the support turned, and the plank remounted such that the plank becomes an out-of-the-way shelf.

FIGS. 20 and 22

Mounting Large Objects

Another use provided by the sawhorse supports is in providing support for heavy workpieces, such as doors and the like. These are clamped alongside the workbench by positioning the supports on the bench legs and resting the heavy workpieces on them, as shown in FIGS. 20 and 22. The heavy workpieces are shown as "G" and "H". Furthermore, the sawhorse supports can be fitted to face in opposite directions and adjusted to different levels on the legs at one end of the bench with the sawhorse plank fitted diagonally through between these two legs, such that the upward-extending end of the plank becomes a convenient platform on which the user can sit when engaged in intricate work, such as on a wood carving. FIGS. 20, 21, 22, and 23 illustrates how the workbench can be used to clamp various workpieces at various angles in various ways.

FIGS. 24–25

Vertical Press

A vertical screw press has a threaded bolt 68 to which a tightening lever 69 is attached. Bolt 68 is screwed through a threaded hole in a member 72 which in turn is welded to a bridgepiece 73. Bridgepiece 73 incorporates a guide lug 74 and a retaining thumbscrew 75. Tension bars 76 are attached to bridgepiece 73 by thumbscrews 75. The lower ends of four tension bars 76 are bent and threaded and pass through holes 77 in bench top 1 and are retained by wingnuts 78 under bench top 1. In practice, bolt 68 may be screwed through member 72 from either the top or the bottom, depending on the type and thickness of the work to be performed. Sheets of plywood or wide-faced workpieces can be glued face to face by supporting them on the bench top and applying vertical force using bolt 68. Edge-to-face gluing can also be done. When gluing numerous narrow strips of wood together, side by side across the bench top, as with butcher block construction, it is necessary to clamp them between the lockstop and the force tool. As increased pressure will cause buckling, downward pressure can also be applied with the triangular screw-type press of FIGS. 24 and 25. The screw-type press can be quickly and easily removed when not required and stored in the swivel drawer of FIG. 1.

When the workbench is dismantled, the parts can be reassembled as shown in FIGS. 26 and 27, into a transportable kit for shipping. Sufficient space is provided in the drawers and kit to package all components and accessories and assembly bolts and screws. It will be seen that bolts "K" and "L" pass through corresponding holes "K" and "L" in the bench legs. These holes are normally used to support the tool deck when the workbench is assembled. One of these bolts pass through a hole in the sawhorse plank marked "L", then both pass through corresponding holes "K" and "L" in the tool deck. Thereafter nuts are fitted to retain the package together, as shown if FIG. 27. Further packaging straps or ties can be used to strengthen the kit before packing into a carton or crate for shipping or storage. The kit can be assembled into a workbench in 10 to 15 minutes.

While the description contains many specificities, these should not be construed as limitations on the scope of the invention, but rather as an exemplification of one preferred embodiment thereof. Many other variations are possible: for example, the sliding lockstop can become a base on which to mount a radial arm saw for accurate positioning along a plank; the sawhorse supports can be used as steps attached to a pipe. Accordingly, the scope of the invention should be determined not by the embodiment illustrated, but by the appended claims and their legal equivalents.

I claim:

1. A workbench comprising:

(a) a rigid planar work surface, said work surface having a bifurcating slot therein which divides said work surface into first and second portions, said second portion being elongated and having an edge spaced from an edge of said first portion in a parallel manner by said slot, (b) a first stop member mounted to said second portion, said stop member having a faceplate perpendicular to said work surface, said first stop member containing slide and locking means, and being extendable around at least a part of said second portion for enabling said first stop member to move along said second portion and be locked in any position therealong, (c) a force-applying tool mounted on said second portion adjacent one end thereof, having a faceplate extending perpendicular to said work surface, and comprising means for moving said faceplate along the length of said second portion so as to be able to clamp and apply force to workpieces of a wide variety of sizes positioned between said faceplate of said first stop member and said force-applying tool, said force-applying tool being pivotable in a direction parallel to said work surface, and (d) a second stop member affixed to said first portion at a location remote from said pivotable force-applying tool and having a faceplate extending perpendicular to said work surface and said faceplate of said first stop member, whereby said force-applying tool can be pivoted around so that its faceplate can face either that of either said first or said second stop member, thereby to be able to clamp and apply force to workpieces of a variety of sizes positioned between said faceplate of said force-applying tool and either of said stop members, (e) said first stop member further comprising a channel part having a center portion extending across a top surface of said second portion of said work surface and having two flanges extending adjacent two respective sides of said second portion, a locking bar extending from said channel part around the sides of said second portion and across the bottom surface of said second portion, said faceplate extending from and perpendicular to said center portion of said channel part, and a pair of ears extending up from said center portion of said channel part and parallel to said flanges, each ear having a hole therein, said locking bar having a pair of arms with a respective pair of guide holes therein adjacent the ends thereof, said guide holes being adjacent the respective holes of said ears, and a locking pin having two kinks and an offset cam portion therebetween, said locking pin extending through both of said pair of holes.

* * * * *